US010851796B2

(12) United States Patent
Li

(10) Patent No.: US 10,851,796 B2
(45) Date of Patent: Dec. 1, 2020

(54) SINGLE-KNOB AIR PUMP

(71) Applicant: WangLi Plastic & Electronics (Huizhou) Co., Ltd., Guangdong (CN)

(72) Inventor: Yonghe Li, Guangdong (CN)

(73) Assignee: WANGLI PLASTIC & ELECTRONICS (HUIZHOU) CO., LTD., Guangdong (CN)

( * ) Notice: Subject to any disclaimer, the term of this patent is extended or adjusted under 35 U.S.C. 154(b) by 258 days.

(21) Appl. No.: 16/001,210

(22) Filed: Jun. 6, 2018

(65) Prior Publication Data

US 2019/0072099 A1 Mar. 7, 2019

(30) Foreign Application Priority Data

Sep. 5, 2017 (CN) ..... 2017 2 1132061 U

(51) Int. Cl.

| | |
|---|---|
| ***F04D 27/00*** | (2006.01) |
| ***F04D 29/40*** | (2006.01) |
| ***F04D 29/08*** | (2006.01) |
| ***F04D 29/70*** | (2006.01) |
| ***F04D 25/08*** | (2006.01) |
| ***A47C 27/08*** | (2006.01) |

(52) U.S. Cl.

CPC ..... *F04D 27/008* (2013.01); *A47C 27/082* (2013.01); *F04D 25/08* (2013.01); *F04D 25/084* (2013.01); *F04D 29/083* (2013.01); *F04D 29/403* (2013.01); *F04D 29/701* (2013.01); *F05D 2260/56* (2013.01)

(58) Field of Classification Search

CPC ..... F04D 29/503; F04D 17/10; F04D 25/06; F04D 25/166; F04D 29/083; F04D 29/403; F04D 29/4206; F04D 29/701; A47C 27/082

See application file for complete search history.

(56) References Cited

U.S. PATENT DOCUMENTS

| | | | | |
|---|---|---|---|---|
| 2008/0201857 | A1* | 8/2008 | Kelly | A47C 27/082 5/713 |
| 2010/0247337 | A1* | 9/2010 | Tsai | A47C 27/082 417/239 |
| 2010/0247356 | A1* | 9/2010 | Tsai | F04D 29/503 417/423.14 |

(Continued)

*Primary Examiner* — Dominick L Plakkoottam

(74) *Attorney, Agent, or Firm* — Muncy, Geissler, Olds & Lowe, P.C.

(57) ABSTRACT

A single-knob air pump includes a housing provided with a first air inlet/outlet and a second air inlet/outlet; an air extracting mechanism arranged in the housing; fan blades of the air extracting mechanism arranged in a fan blade chamber provided with an air inlet and an air outlet; an air channel switching mechanism arranged near the fan blade chamber and provided with an air inlet and an air outlet; the air channel switching mechanism operatively connected to a knob mechanism which can control the displacement of the air channel switching mechanism; the second air inlet/outlet provided with an air valve mechanism capable of closing or opening the second air inlet/outlet; and an ejector rod mechanism capable of closing or opening the second air inlet/outlet through the air valve mechanism under the action of the air channel switching mechanism arranged between the air valve mechanism and the air channel switching mechanism.

13 Claims, 8 Drawing Sheets

(56) References Cited

U.S. PATENT DOCUMENTS

2015/0316067 A1* 11/2015 Tsai ..... F04D 25/06
417/15
2016/0123349 A1* 5/2016 Wang ..... F04D 29/503
415/175

* cited by examiner

SINGLE-KNOB AIR PUMP

TECHNICAL FIELD

The present application relates to the technical field of air pumps, and in particular to a single-knob air pump.

BACKGROUND ART

An inflatable air pump is used in cooperation with an inflatable product to inflate the inflatable product. Inflatable air pumps are fixed on some large inflatable products, and air inlets are arranged on the inflatable air pumps. When the inflatable product is inflated, the air inlet is opened so that the inflatable air pump can fill the inner chamber of the inflatable product with air. After the inflation is completed, the air inlet is closed to prevent the air in the inflatable product from leaking.

SUMMARY OF THE INVENTION

In view of the above, a desired advantage of the present invention is to provide a single-knob air pump that can be switched flexibly to overcome deficiencies of the prior art.

In order to solve the above technical problems, the present invention employs schemes as follows.

A single-knob air pump includes a housing which is provided with a first air inlet/outlet and a second air inlet/outlet; an air extracting mechanism is arranged in the housing, and fan blades of the air extracting mechanism are arranged in a fan blade chamber provided with an air inlet and an air outlet;

an air channel switching mechanism is arranged near the fan blade chamber and is provided with an air inlet and an air outlet; the air channel switching mechanism is operatively connected to a knob mechanism which can control the displacement of the air channel switching mechanism; and the second air inlet/outlet is provided with an air valve mechanism capable of closing or opening the second air inlet/outlet, and an ejector rod mechanism capable of closing or opening the second air inlet/outlet through the air valve mechanism under the action of the air channel switching mechanism is provided between the air valve mechanism and the air channel switching mechanism, so that when the air inlet of the air channel switching mechanism controlled by the knob mechanism is brought into contact with and is communicated with the air outlet of the fan blade chamber, the air outlet of the air channel switching mechanism is opposite to the second air inlet/outlet and the air channel switching mechanism drives the ejector rod mechanism to open the second inlet/outlet through the air valve mechanism, thus performing inflation; or when the air inlet of the air channel switching mechanism controlled by the knob mechanism is not communicated with the air outlet of the fan blade chamber, the air outlet of the air channel switching mechanism is opposite to the second air inlet/outlet and the air channel switching mechanism drives the ejector rod mechanism to open the second inlet/outlet through the air valve mechanism, thus performing inflation; or when the knob mechanism controls the air channel switching mechanism to drive the ejector rod mechanism so as to make the air valve mechanism in a restored state, the air valve mechanism closes the second air inlet/outlet to stop working.

The air pump in the present application is used to inflate or deflate the inflatable product. The second inlet/outlet is communicated with the inner chamber of the inflatable product, and the first inlet/outlet is communicated with the outside. The air enters the air pump from the first inlet/outlet and then enters the inflatable product from the second inlet/outlet.

In the inflated state, the air extracting mechanism operates, so that outside air enters the housing from the first air inlet/outlet, enters the fan blade chamber from the air inlet of the fan blade chamber, then enters the air channel switching mechanism from the air outlet of the fan blade chamber, and finally enters the inner chamber of the inflatable product from the air channel switching mechanism through the second air inlet/outlet.

After inflation is completed, the knob mechanism is rotated to reset the air valve mechanism, and thus the second air inlet/outlet is closed.

When the pump is in the deflated state, the air extracting mechanism operates (at this time, the air extracting mechanism does not change the direction of the extracted air). Since the air inlet of the air channel switching mechanism is not communicated directly with the air outlet of the fan blade chamber and the air outlet of the air channel switching mechanism is still opposite to the second air inlet/outlet, the air in the inflatable product enters the air channel switching mechanism through the second air inlet/outlet, enters a low pressure area in the housing from the air channel switching mechanism, then enters the fan blade chamber through the air inlet of the fan blade chamber, and finally flows out the fan blade chamber through the air outlet of the fan blade chamber and is discharged through the first air inlet/outlet of the housing.

In order to facilitate the switching of the air channel during the switching of the air channel mechanism controlled by the knob mechanism, the air outlet of the air channel switching mechanism is provided with a V-shaped structure including a first inclined plane and a second inclined plane, so that in the inflated state, the first inclined plane abuts the ejector rod mechanism; or in the deflated state, the second inclined plane abuts the ejector rod mechanism. When the knob mechanism controls the air channel switching mechanism to linearly reciprocate, the first inclined plane can abut the ejector rod mechanism or the second inclined plane can abut the ejector rod mechanism. When both the first inclined plane and the second inclined plane do not abut the ejector rod mechanism, the air valve mechanism is in a restored state (i.e., the air pump is in a stopped state, and the air valve mechanism closes the second air inlet/outlet).

Further, the ejector rod mechanism includes a first ejector rod and a second ejector rod intersecting with each other, a pair of guide slots are arranged in the housing, wherein two ends of the second ejector rod are embedded in the guide slot, one end of the first ejector rod can abut the first inclined plane or the second inclined plane of the air channel switching mechanism, and the other end can operates the air valve mechanism; therefore, in the inflated state, the first inclined plane abuts an end of the first ejector rod and the other end of the first ejector rod operates the air valve mechanism, or in the deflated state, the second inclined plane abuts an end of the first ejector rod and the other end of the first ejector rod operates the air valve mechanism.

The other end of the first ejector rod is brought into contact with and fixed to the air valve mechanism. The direct contact and fixation between the first ejector rod and the air valve mechanism ensure that the air valve mechanism can open or close the second air inlet/outlet stably. In addition, if the air valve mechanism adopts an elastic restoring method, when a failure occurs in the air valve mechanism, the first ejector rod can also drive the air valve mechanism to close the second inlet/outlet.

The air valve mechanism includes a breathable mesh cover arranged on the second air inlet/outlet, and the mesh cover is provided with a seal assembly capable of being compressed or reset by the ejector rod mechanism; when the seal assembly is in a compressed state, the seal assembly opens the second air inlet/outlet; or when the seal assembly is in a reset state, the seal assembly closes the second air inlet/outlet.

The seal assembly includes a platen arranged in the mesh cover, which is provided with a seal ring used for sealing and a guide rod which can penetrate the mesh cover, and a spring is sleeved outside the guide rod, between the platen and the mesh cover; under the operation of the platen by the ejector rod mechanism, the seal assembly opens or closes the second air inlet/outlet.

The knob mechanism includes an air channel switching paddle which is rotatably arranged, a knob is connected to the front surface of the air channel switching paddle, and a blocking rod is arranged on the back surface thereof; a sliding slot is arranged on the air channel switching mechanism, and the blocking rod is embedded in the sliding slot. When the air channel switching paddle rotates, the moving path of the blocking rod fixed thereon is a circumferential track, the slide slot has a certain length, and the slide slot can linearly reciprocate under the action of the blocking rod.

The air extracting mechanism includes a motor and fan blades, and a pressing switch that can control the operation of the motor is arranged near the air channel switching paddle; the edge of the air channel switching paddle is provided with a contact portion for an inflated state, a contact portion for a deflated state and a non-contact portion for a stopped state between the contact portion for an inflated state and the contact portion for a deflated state; in the inflated state, the contact portion for an inflated state is brought into contact with the pressing switch, and the pressing switch turns on the circuit; in the deflated state, the contact portion for a deflated state is brought into contact with the pressing switch, and the pressing switch turns on the circuit; and in the stopped state, the non-contact portion for a stopped state is separated from the pressing switch. The knob mechanism in the present invention cooperates with the pressing switch to complete the switching of the air channel while inflating or deflating, so that the operation is extremely flexible.

The housing includes a wire slot accommodating chamber and an assembly accommodating chamber, wherein the air extracting mechanism and the air channel switching mechanism are arranged in the assembly accommodating chamber; the housing also includes a housing base and a panel, a detachable cover plate is arranged on the panel corresponding to the wire slot accommodating chamber; and the second air inlet/outlet is arranged on the housing base, and the first air inlet/outlet is arranged on the panel corresponding to the assembly accommodating chamber. The wire slot accommodating chamber can be used to collect wires so as to prevent the wires from being too cluttered.

A gap is provided between the wire slot accommodating chamber and the assembly accommodating chamber and the cover plate is in non-sealing contact with the panel. If there are too many first air inlets/outlets on the panel or the first air inlet/outlet is too large, the appearance of the panel will be affected and the panel will even hide dirt and dust. Therefore, the gap between the cover plate and the panel is used to inlet or outlet air, so that air is exchanged through the gap between the wire slot accommodating chamber and the assembly accommodating chamber to avoid arranging excessive first air inlets/outlets on the panel.

Compared with prior art, beneficial effects of the present invention are as follows. According to the present invention, by means of the cooperation of a air extracting mechanism, a fan blade chamber, an air channel switching mechanism, a knob mechanism, an air valve mechanism and an ejector rod mechanism, the air channel switching machine is made flexible so that the inflatable product can be inflated or deflated on the premise that the air extracting direction of the air extracting mechanism is not changed.

DESCRIPTION OF THE EMBODIMENTS

Figure 1:
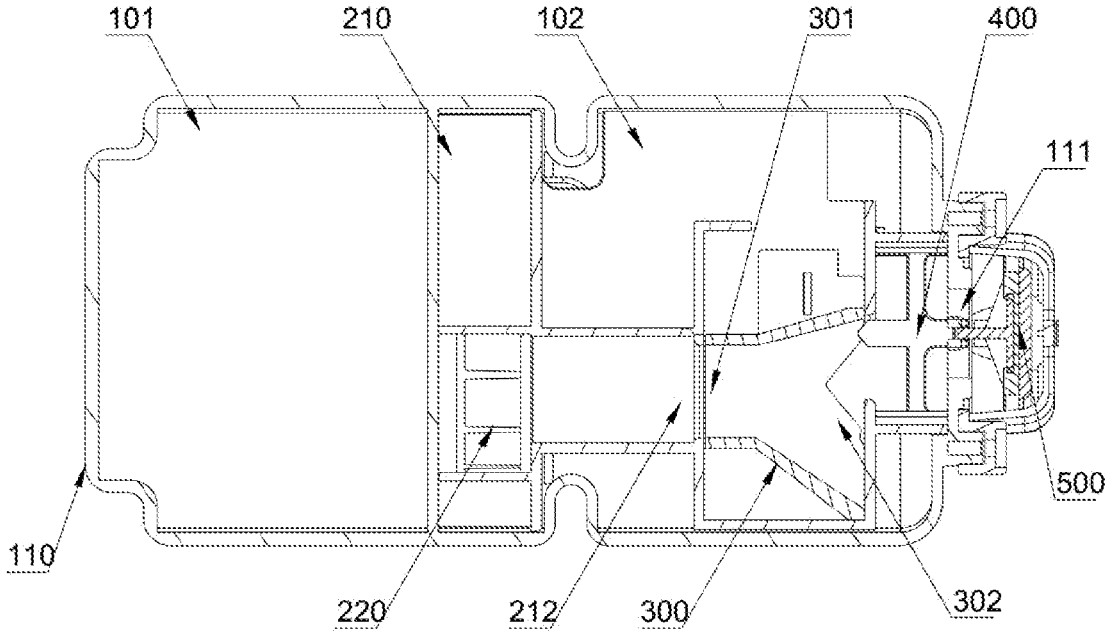
FIG. 1 is a schematic structural diagram of a single-knob air pump (inflated state)

In order to enable those skilled in the art to better understand the technical solutions of the present invention, the present invention will be further described below with reference to the accompanying drawings. As shown in FIGS. 1 to 4, a single-knob air pump includes a housing comprising a wire slot accommodating chamber 101 and an assembly accommodating chamber 102; the housing includes a housing base 110 and a panel 120 provided with a detachable cover plate 130 corresponding to the wire slot accommodating chamber 101; and first air inlets/outlets 121 corresponding to the assembly accommodating chamber 102 are arranged on the panel 120, and a second air inlet/outlet 111 is arranged on the housing base 110. A gap 103 is provided between the wire slot accommodating chamber 101 and the assembly accommodating chamber 102, and the cover plate 130 is in non-sealing contact with the panel 120 so that air can flow through the gap, as shown by the arrow b in FIG. 11 and arrow e in FIG. 12.

Figure 3:
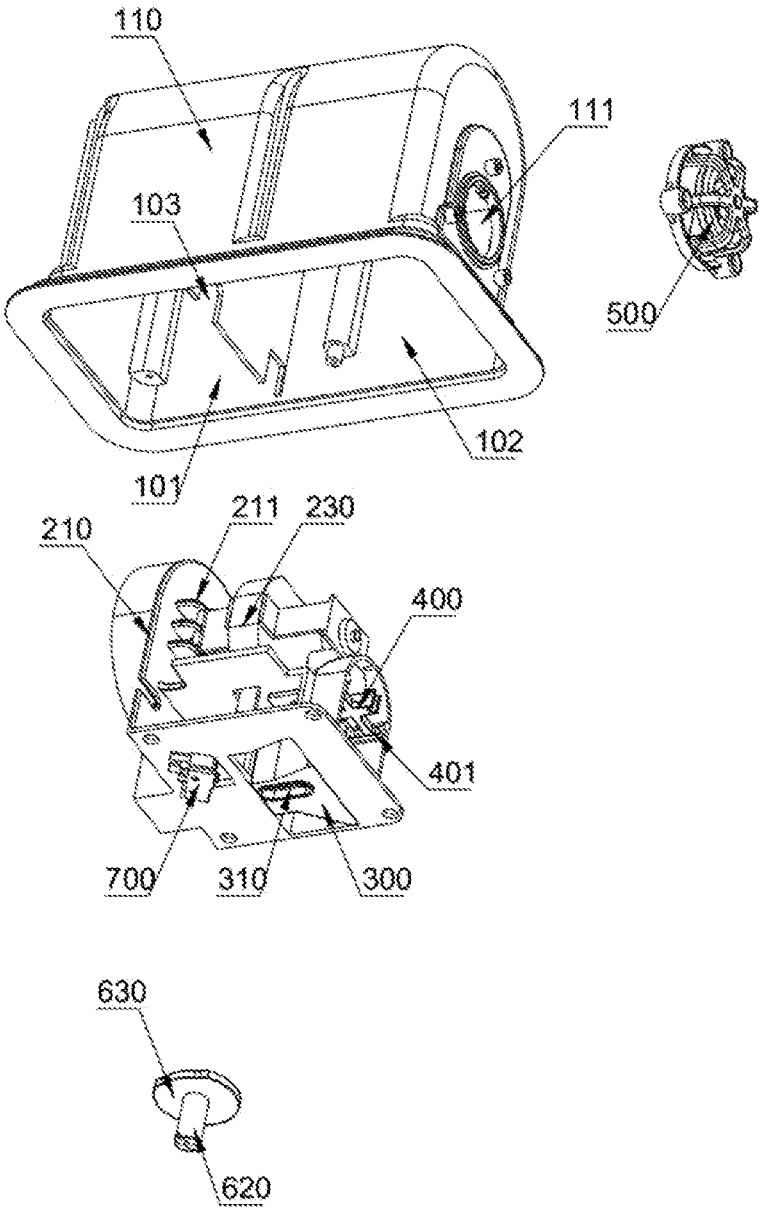
FIG. 3 is an exploded view of a local structure of the single-knob air pump.
Figure 4:
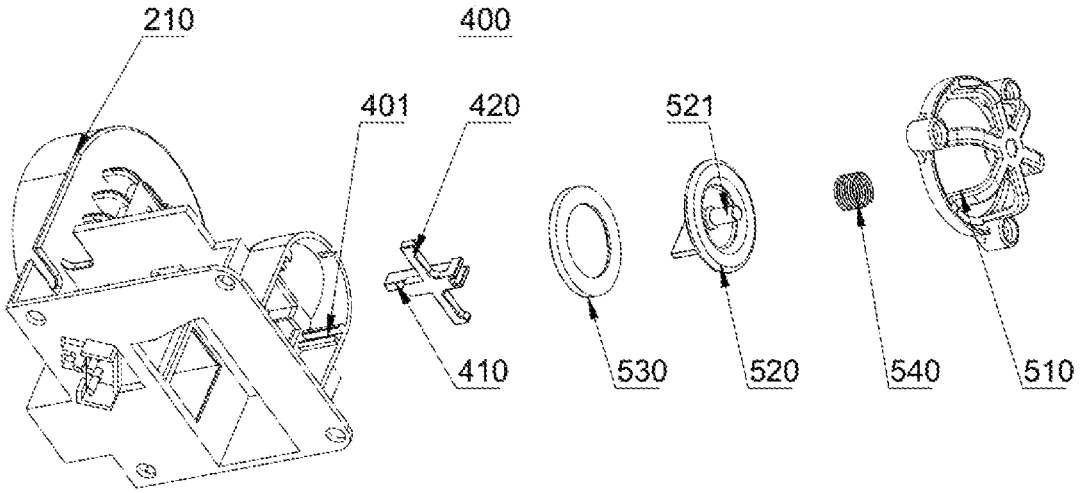
FIG. 4 is an exploded view of another local structure of the single-knob air pump.
Figure 5:
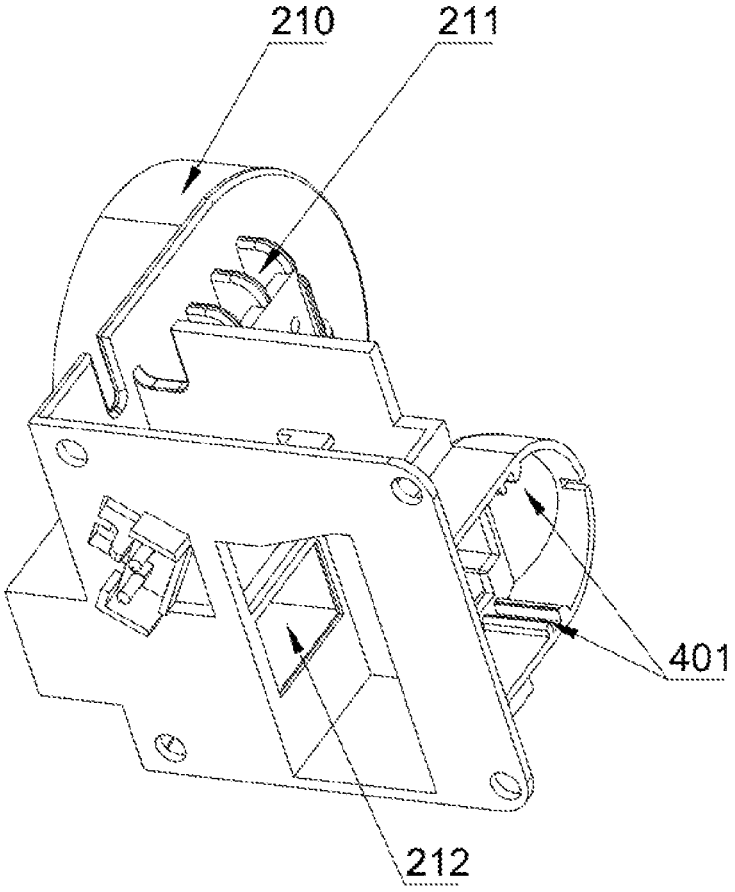
FIG. 5 is a schematic diagram of a local structure of the single-knob air pump.
Figure 6:
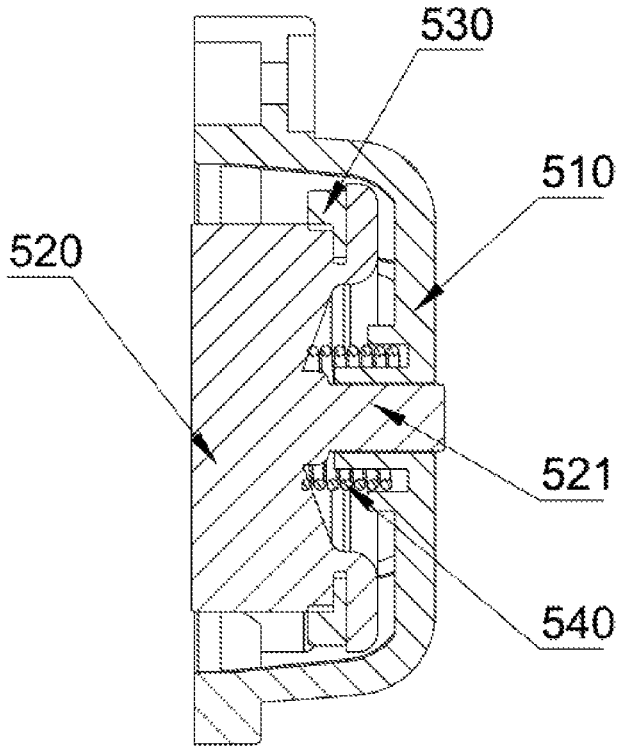
FIG. 6 is a schematic structural view of an air valve mechanism.

As shown in FIGS. 3 to 5, an air extracting mechanism is arranged in the housing, which includes a motor 230 and fan blades 220. The fan blades 220 of the air extracting mechanism are arranged in a fan blade chamber 210 provided with an air inlet 211 and an air outlet 212.

As shown in FIGS. 1 to 8, an air channel switching mechanism 300 is arranged near the fan blade chamber 210 and is provided with an air inlet 301 and an air outlet 302; the air outlet 302 of the air channel switching mechanism 300 is provided with a V-shaped structure 320 including a first inclined plane 321 and a second inclined plane 322.

Figure 7:
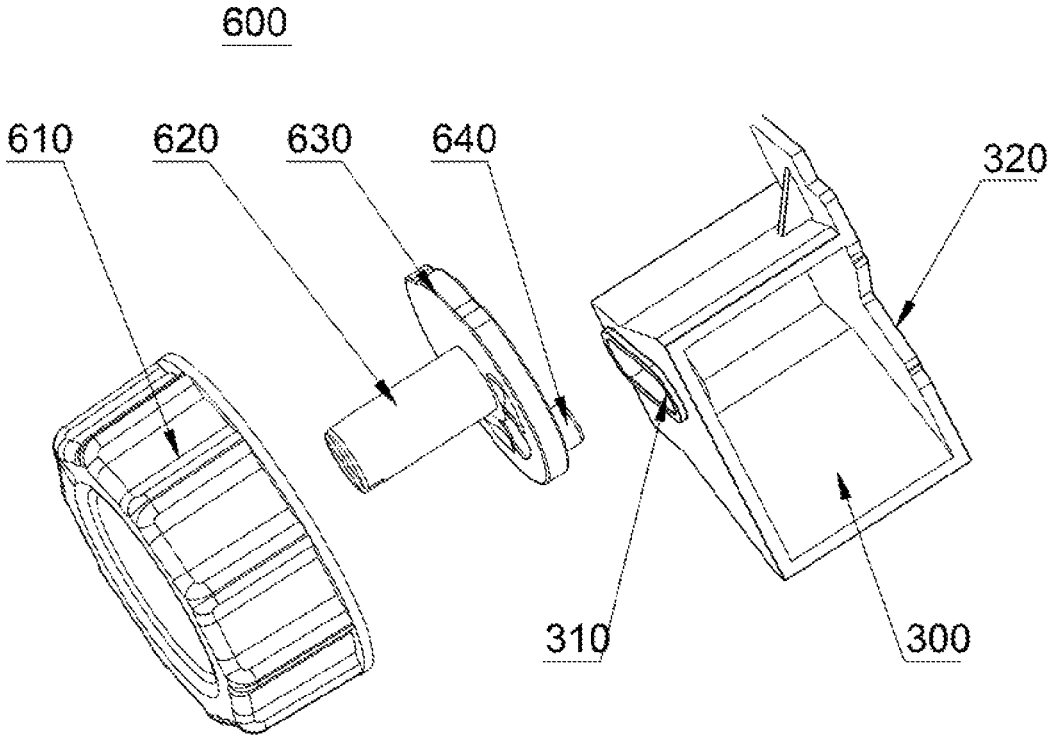
FIG. 7 is an exploded structural view of a knob mechanism.
Figure 8:
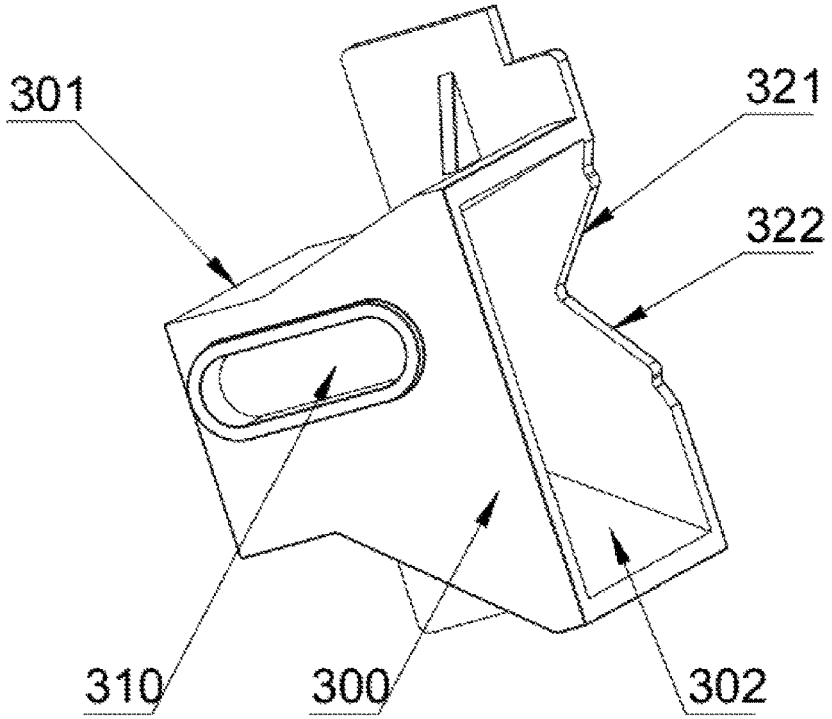
FIG. 8 is a schematic structural view of an air channel switching mechanism.
Figure 9:
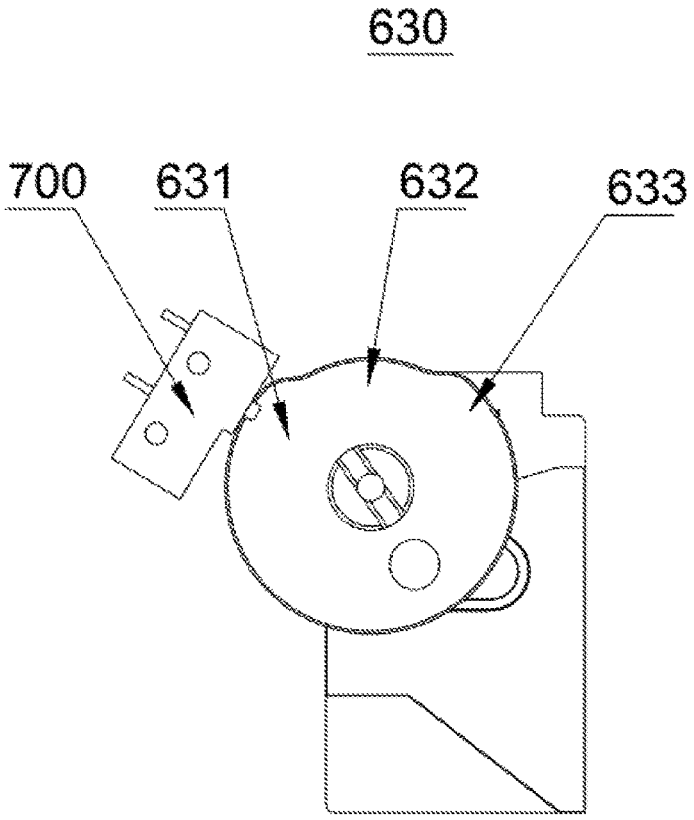
FIG. 9 is a schematic diagram showing the cooperation between the knob mechanism and a pressing switch (in inflated state)
Figure 10:
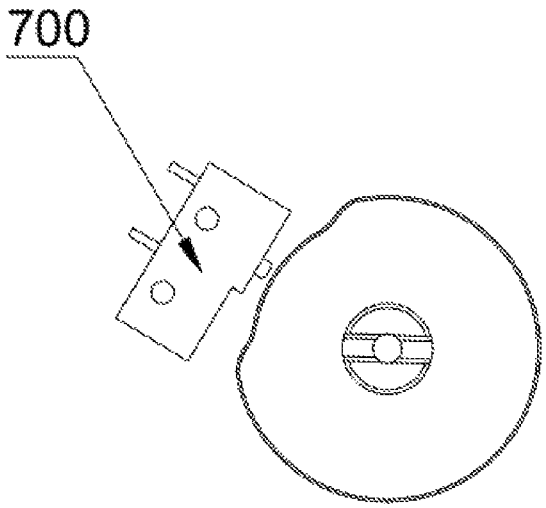
FIG. 10 is a schematic diagram showing the cooperation between the knob mechanism and the pressing switch (in stopped state)

As shown in FIG. 7 and FIG. 8, the air channel switching mechanism 300 is operatively connected to a knob mechanism 600 which can control the displacement of the air channel switching mechanism 300; the knob mechanism 600 includes an air channel switching paddle 630 which is rotatably arranged, a knob 610 is connected to the front surface of the air channel switching paddle 630 through a link rod 620, and a blocking rod 640 is arranged on the back surface thereof; and a sliding slot 310 is arranged on the air channel switching mechanism 300, and the blocking rod 640 is embedded in the sliding slot 310. As shown in FIG. 9, a pressing switch 700 that can control the operation of the motor is arranged near the air channel switching paddle 630; the edge of the air channel switching paddle 630 is provided with a contact portion for an inflated state 631, a contact portion for a deflated state 633 and a non-contact portion for a stopped state 632 between the contact portion for an inflated state and the contact portion foe a deflated state (as shown in FIG. 10, in the stopped state, the non-contact portion for stopped state 632 is separated from the pressing switch 700 to turn off the circuit).

Figure 2:
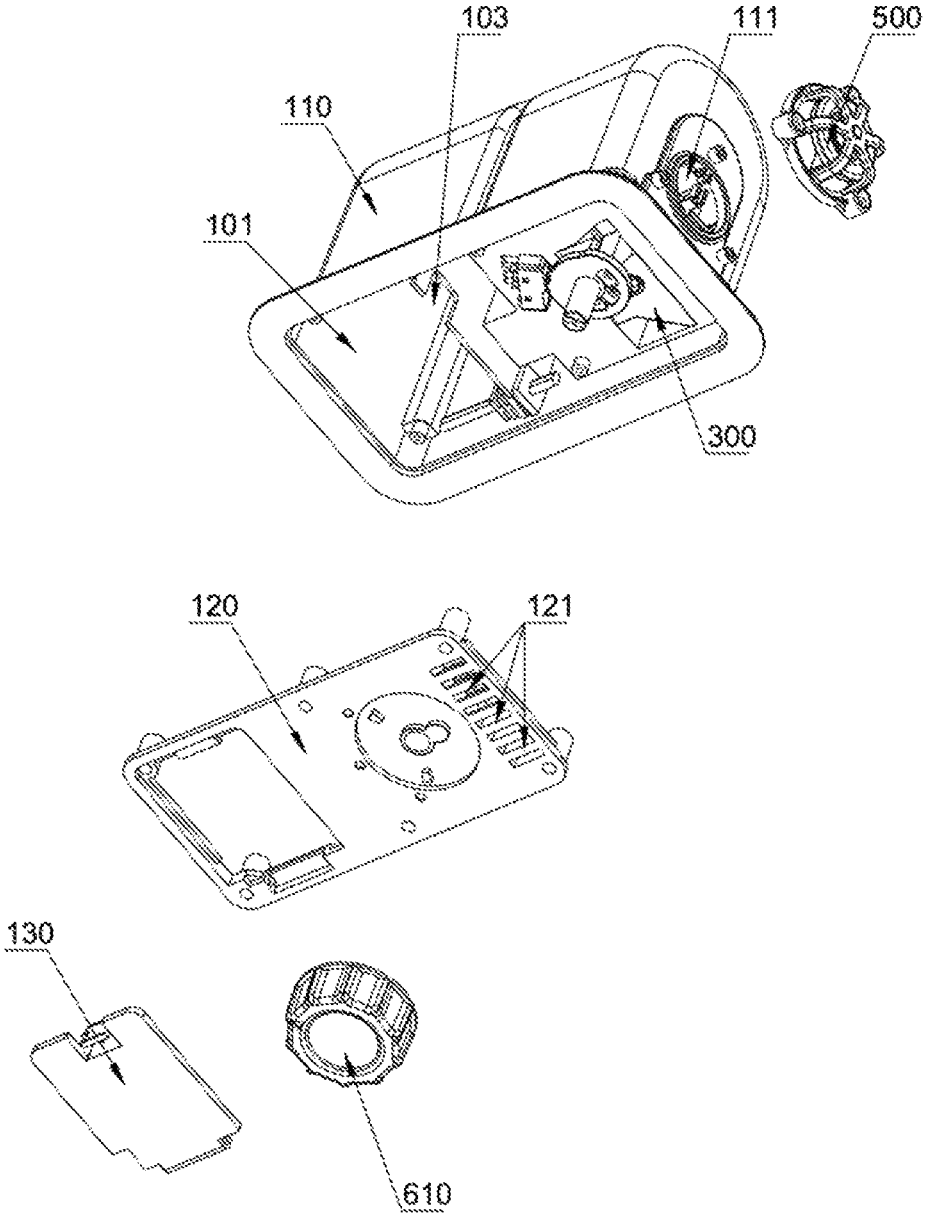
FIG. 2 is an exploded view of the single-knob air pump.

As shown in FIGS. 2 and 4, the second air inlet/outlet 111 is provided with an air valve mechanism 500 capable of closing or opening the second air inlet/outlet 111, an ejector rod mechanism 400 capable of closing or opening the second air inlet/outlet through the air valve mechanism under the action of the air channel switching mechanism is arranged between the air valve mechanism 500 and the air channel switching mechanism 300. The ejector rod mechanism 400 includes a first ejector rod 410 and a second ejector rod 420 intersecting with each other, a pair of guide slots 401 are arranged in the housing, two ends of the second ejector rod 420 are embedded in the guide slots 401, one end of the first ejector rod 410 can abut the first inclined plane 321 or the second inclined plane 322 of the air channel switching mechanism, and the other end can operate the air valve mechanism 500.

The air valve mechanism 500 includes a breathable mesh cover 510 arranged on the second air inlet/outlet 111, and a seal assembly capable of being compressed or reset by the ejector rod mechanism 400 is arranged in the mesh cover 510; the seal assembly includes a platen 520 arranged in the mesh cover, the platen 520 is provided with a seal ring 530 which can be used for sealing and a guide rod 521 which can penetrate the mesh cover, and a spring 540 is sleeved outside the guide rod, between the platen and the mesh cover.

Figure 11:
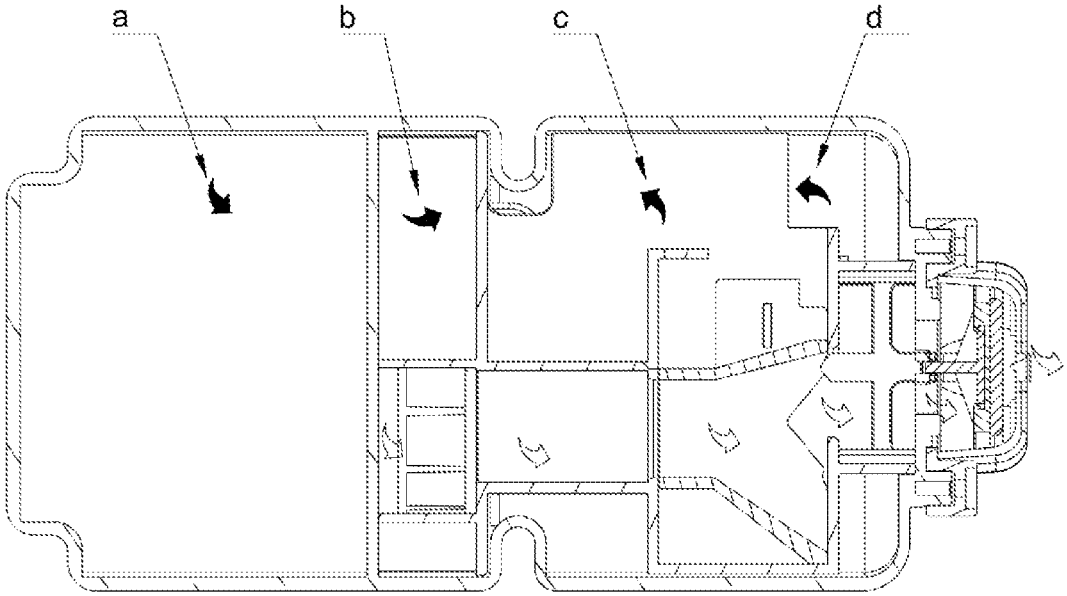
FIG. 11 is a schematic diagram of the present invention in inflated state.

FIG. 11 shows the inflated state of the present invention, the knob mechanism is rotated, and the contact portion for an inflated state 631 of the air channel switching paddle 630 is brought into contact with the pressing switch 700 to turn on the circuit; at the same time, the air channel switching mechanism 300 moves downwards under the action of the blocking rod 640, so that the air inlet 301 of the air channel switching mechanism is brought into contact with and is communicated with the air outlet 212 of the fan blade chamber, the first inclined plane 321 of the air channel switching mechanism operates an end of the first ejector rod 410, and the other end of the first ejector rod 410 operates the air valve mechanism 500 with the guiding of the second ejector rod; and the platen 520 of the air valve mechanism is compressed toward the mesh cover 510, and the second air inlet/outlet 111 is opened, thus carrying out inflating. The flow of the air in inflation is shown by arrows in FIG. 11, an arrow "a" indicates that the air flow enters the wire slot accommodating chamber from a gap between the cover plate and the panel, an arrow "b" indicates that the air flow enters the assembly accommodating chamber from a gap between the wire slot accommodating chamber and the assembly accommodating chamber, an arrow "c" indicates that the air flow collected in the assembly accommodating chamber will enter the fan blade chamber from the air inlet of the fan blade chamber, and an arrow "d" indicates that the air flow enters the assembly accommodating chamber from the first inlet/outlet.

Figure 12:
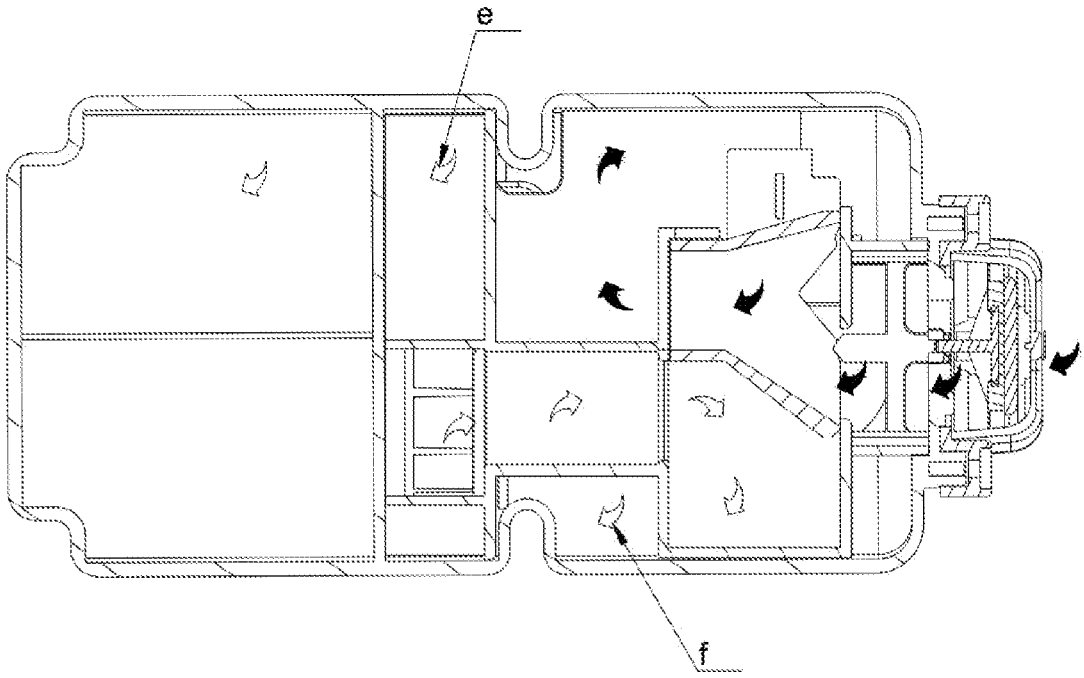
FIG. 12 is a schematic diagram of the present invention in deflated state.
Figure 13:
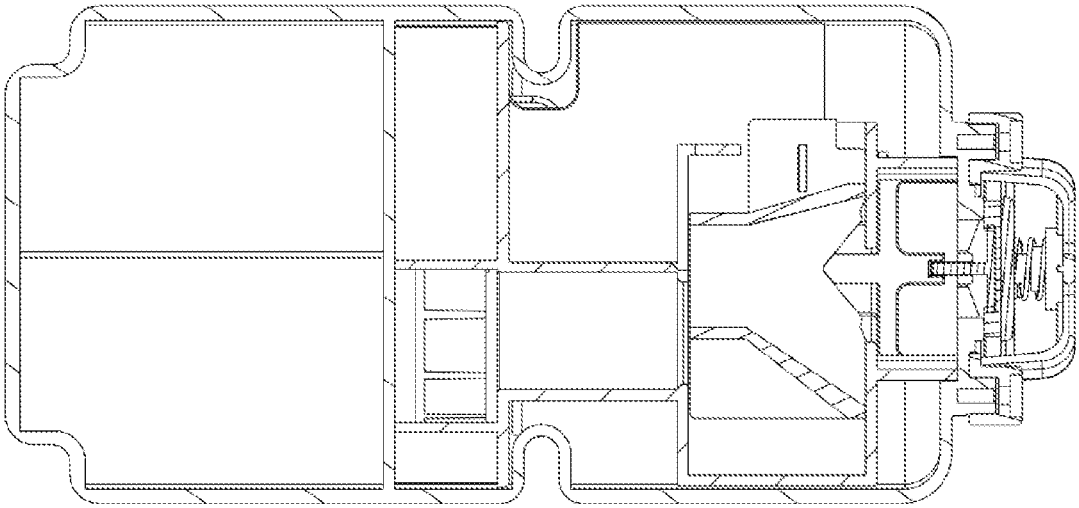
FIG. 13 is a schematic diagram of the present invention in stopped state.

FIG. 12 shows the deflated state of the present invention, the knob mechanism is rotated, and the contact portion for a deflated state 633 of the air channel switching paddle 630 is brought into contact with the pressing switch 700 to turn on the circuit; at the same time, the air channel switching mechanism 300 moves upwards under the action of the blocking rod 640, so that the air inlet 301 of the air channel switching mechanism is not brought into contact with and is not communicated with the air outlet 212 of the fan blade chamber, the second inclined plane 322 of the air channel switching mechanism 300 operates an end of the first ejector rod 410, and the other end of the first ejector rod 410 operates the air valve mechanism 500 with the guiding of the second ejector rod 420; and the platen 520 of the air valve mechanism is compressed toward the mesh cover 510, and the second air inlet/outlet 111 is opened, thus carrying out deflating. The flow of the air in deflation is shown in FIG. 12, an arrow "e" indicates that the air flow enters the wire slot accommodating chamber from the assembly accommodating chamber through the gap and then is discharged through the gap between the cover plate and the panel; an arrow "f" indicates that the air flow exits from the outlet of the fan blade chamber and then is discharged through the first air inlet/outlet on the panel.

The above embodiment is only a specific implementation of the present invention. Although the descriptions thereof are specific and detailed, they should not be construed as a limitation of the scope of the present invention. It should be noted that for a person of ordinary skill in the art, several variations and improvements may be made without departing from the spirit of the present invention. These obvious alternatives are intended to be included in the scope of protection of the present invention.

What is claimed is:

1. A single-knob air pump comprising a housing which is provided with a first air inlet/outlet and a second air inlet/outlet, wherein:

an air extracting mechanism is arranged in the housing, and fan blades of the air extracting mechanism are arranged in a fan blade chamber provided with an air inlet and an air outlet;

an air channel switching mechanism is arranged near the fan blade chamber and is provided with an air inlet and an air outlet; the air channel switching mechanism is operatively connected to a knob mechanism which can control the displacement of the air channel switching mechanism; and the second air inlet/outlet is provided with an air valve mechanism capable of closing or opening the second air inlet/outlet, and an ejector rod mechanism capable of closing or opening the second air inlet/outlet through the air valve mechanism under the action of the air channel switching mechanism is provided between the air valve mechanism and the air channel switching mechanism; so that when the air inlet of the air channel switching mechanism controlled by the knob mechanism is brought into contact with and is communicated with the air outlet of the fan blade chamber, the air outlet of the air channel switching mechanism is opposite to the second air inlet/outlet and the air channel switching mechanism drives the ejector rod mechanism to open the second inlet/outlet through the air valve mechanism, thus performing inflation; or when the air inlet of the air channel switching mechanism controlled by the knob mechanism is not communicated with the air outlet of the fan blade chamber, the air outlet of the air channel switching mechanism is opposite to the second air inlet/outlet and the air channel switching mechanism drives the ejector rod mechanism to open the second inlet/outlet through the air valve mechanism, thus performing deflation; or when the knob mechanism controls the air channel switching mechanism to drive the ejector rod mechanism so as to make the air valve mechanism in a restored state, the air valve mechanism closes the second air inlet/outlet to stop working; and wherein the air valve mechanism includes a breathable mesh cover arranged on the second air inlet/outlet, and a seal assembly capable of being compressed or reset by the ejector rod mechanism is arranged in the mesh cover; when the seal assembly is in a compressed state, the seal assembly opens the second air inlet/outlet; or when the seal assembly is in a reset state, the seal assembly closes the second air inlet/outlet.

2. The single-knob air pump according to claim 1, wherein the air outlet of the air channel switching mechanism is provided with a V-shaped structure, including a first inclined plane and a second inclined plane; when the pump is in an inflation mode, the first inclined plane abuts the ejector rod mechanism; or when the pump is in a deflation mode, the second inclined plane abuts the ejector rod mechanism.

3. The single-knob air pump according to claim 2, wherein the ejector rod mechanism includes a first ejector rod and a second ejector rod intersecting with each other, a pair of guide slots are arranged in the housing, and two ends of the second ejector rod are embedded in the guide slots, one end of the first ejector rod can abut the first inclined plane or the second inclined plane of the air channel switching mechanism, and the other end thereof can operate the air valve mechanism;

wherein when the pump is in the inflation mode, the first inclined plane abuts an end of the first ejector rod and the other end of the first ejector rod operates the air valve mechanism; or wherein when the pump is in the deflation mode, the second inclined plane abuts an end of the first ejector rod and the other end of the first ejector rod operates the air valve mechanism.

4. The single-knob air pump according to claim 3, wherein the other end of the first ejector rod is brought into contact with and fixed to the air valve mechanism.

5. The single-knob air pump according to claim 1, wherein the seal assembly includes a platen arranged in the mesh cover, which is provided with a seal ring used for sealing and a guide rod which can penetrate the mesh cover, and a spring is sleeved outside the guide rod, between the platen and the mesh cover; under the operation of the platen by the ejector rod mechanism, the seal assembly opens or closes the second air inlet/outlet.

6. The single-knob air pump according to claim 1, wherein the knob mechanism includes an air channel switching paddle which is rotatably arranged, a knob is connected to the front surface of the air channel switching paddle, and a blocking rod is arranged on the back surface thereof; a sliding slot is arranged on the air channel switching mechanism, and the blocking rod is embedded in the sliding slot.

7. The single-knob air pump according to claim 6, wherein the air extracting mechanism includes a motor, and a pressing switch that can control the operation of the motor is arranged near the air channel switching paddle; the edge of the air channel switching paddle is provided with a first contact portion for the inflation mode of the pump, a second contact portion for the deflation mode of the pump and a non-contact portion for a stopped mode of the pump between the first contact portion and the second contact portion; in the inflation mode of the pump, the first contact portion is brought into contact with the pressing switch, and the pressing switch turns on an electrical circuit; in the deflation mode of the pump, the second contact portion is brought into contact with the pressing switch, and the pressing switch turns on the electrical circuit; and in the stopped mode of the pump, the non-contact portion is separated from the pressing switch.

8. The single-knob air pump according to claim 1, wherein the housing includes a wire slot accommodating chamber and an assembly accommodating chamber;

the air extracting mechanism and the air channel switching mechanism are arranged in the assembly accommodating chamber; the housing includes a housing base and a panel, a detachable cover plate is arranged on the panel corresponding to the wire slot accommodating chamber; and the second air inlet/outlet is arranged on the housing base, and the first air inlet/outlet is arranged on the panel corresponding to the assembly accommodating chamber.

9. The single-knob air pump according to claim 8, wherein a gap is provided between the wire slot accommodating chamber and the assembly accommodating chamber, and the cover plate is in non-sealing contact with the panel.

10. A single-knob air pump comprising a housing which is provided with a first air inlet/outlet and a second air inlet/outlet, wherein:

an air extracting mechanism is arranged in the housing, and fan blades of the air extracting mechanism are arranged in a fan blade chamber provided with an air inlet and an air outlet;

an air channel switching mechanism is arranged near the fan blade chamber and is provided with an air inlet and an air outlet; the air channel switching mechanism is operatively connected to a knob mechanism which can control the displacement of the air channel switching mechanism; and the second air inlet/outlet is provided with an air valve mechanism capable of closing or opening the second air inlet/outlet, and an ejector rod mechanism capable of closing or opening the second air inlet/outlet through the air valve mechanism under the action of the air channel switching mechanism is provided between the air valve mechanism and the air channel switching mechanism; so that when the air inlet of the air channel switching mechanism controlled by the knob mechanism is brought into contact with and is communicated with the air outlet of the fan blade chamber, the air outlet of the air channel switching mechanism is opposite to the second air inlet/outlet and the air channel switching mechanism drives the ejector rod mechanism to open the second inlet/outlet through the air valve mechanism, thus performing inflation; or when the air inlet of the air channel switching mechanism controlled by the knob mechanism is not communicated with the air outlet of the fan blade chamber, the air outlet of the air channel switching mechanism is opposite to the second air inlet/outlet and the air channel switching mechanism drives the ejector rod mechanism to open the second inlet/outlet through the air valve mechanism, thus performing deflation; or when the knob mechanism controls the air channel switching mechanism to drive the ejector rod mechanism so as to make the air valve mechanism in a restored state, the air valve mechanism closes the second air inlet/outlet to stop working;

wherein the air outlet of the air channel switching mechanism is provided with a V-shaped structure, including a first inclined plane and a second inclined plane; when the pump is in an inflation mode, the first inclined plane abuts the ejector rod mechanism; or when the pump is in an deflation mode, the second inclined plane abuts the ejector rod mechanism; and wherein the ejector rod mechanism includes a first ejector rod and a second ejector rod intersecting with each other, a pair of guide slots are arranged in the housing, and two ends of the second ejector rod are embedded in the guide slots, one end of the first ejector rod can abut the first inclined plane or the second inclined plane of the air channel switching mechanism, and the other end thereof can operate the air valve mechanism; when the pump is in the inflation mode, the first inclined plane abuts an end of the first ejector rod and the other end of the first ejector rod operates the air valve mechanism; or when the pump is in the deflation mode, the second inclined plane abuts an end of the first ejector rod and the other end of the first ejector rod operates the air valve mechanism.

11. The single-knob air pump according to claim 10, wherein the other end of the first ejector rod is brought into contact with and fixed to the air valve mechanism.

12. A single-knob air pump comprising a housing which is provided with a first air inlet/outlet and a second air inlet/outlet, wherein:

an air extracting mechanism is arranged in the housing, and fan blades of the air extracting mechanism are arranged in a fan blade chamber provided with an air inlet and an air outlet;

an air channel switching mechanism is arranged near the fan blade chamber and is provided with an air inlet and an air outlet; the air channel switching mechanism is operatively connected to a knob mechanism which can control the displacement of the air channel switching mechanism; and the second air inlet/outlet is provided with an air valve mechanism capable of closing or opening the second air inlet/outlet, and an ejector rod mechanism capable of closing or opening the second air inlet/outlet through the air valve mechanism under the action of the air channel switching mechanism is provided between the air valve mechanism and the air channel switching mechanism; so that when the air inlet of the air channel switching mechanism controlled by the knob mechanism is brought into contact with and is communicated with the air outlet of the fan blade chamber, the air outlet of the air channel switching mechanism is opposite to the second air inlet/outlet and the air channel switching mechanism drives the ejector rod mechanism to open the second inlet/outlet through the air valve mechanism, thus performing inflation; or when the air inlet of the air channel switching mechanism controlled by the knob mechanism is not communicated with the air outlet of the fan blade chamber, the air outlet of the air channel switching mechanism is opposite to the second air inlet/outlet and the air channel switching mechanism drives the ejector rod mechanism to open the second inlet/outlet through the air valve mechanism, thus performing deflation; or when the knob mechanism controls the air channel switching mechanism to drive the ejector rod mechanism so as to make the air valve mechanism in a restored state, the air valve mechanism closes the second air inlet/outlet to stop working; and wherein the knob mechanism includes an air channel switching paddle which is rotatably arranged, a knob is connected to the front surface of the air channel switching paddle, and a blocking rod is arranged on the back surface thereof; a sliding slot is arranged on the air channel switching mechanism, and the blocking rod is embedded in the sliding slot.

13. The single-knob air pump according to claim 12, wherein the air extracting mechanism includes a motor, and a pressing switch that can control the operation of the motor is arranged near the air channel switching paddle; the edge of the air channel switching paddle is provided with a first contact portion for the inflation mode of the pump, a second contact portion for the deflation mode of the pump and a non-contact portion for a stopped mode of the pump between the first contact portion and the second contact portion; in the inflation mode of the pump, the first contact portion is brought into contact with the pressing switch, and the pressing switch turns on an electrical circuit; in the deflation mode of the pump, the second contact portion is brought into contact with the pressing switch, and the pressing switch turns on the electrical circuit; and in the stopped mode of the pump, the non-contact portion is separated from the pressing switch.

* * * * *